US006854691B2

(12) United States Patent
Kraeling et al.

(10) Patent No.: US 6,854,691 B2
(45) Date of Patent: Feb. 15, 2005

(54) RAILROAD COMMUNICATION SYSTEM

(75) Inventors: Mark Bradshaw Kraeling, Melbourne, FL (US); Robert James Foy, Melbourne, FL (US); Glen Paul Peltonen, Melbourne, FL (US); Robert Dwain Lee, Jr., West Melbourne, FL (US)

(73) Assignee: General Electric Company

( * ) Notice: Subject to any disclaimer, the term of this patent is extended or adjusted under 35 U.S.C. 154(b) by 170 days.

(21) Appl. No.: 10/218,501

(22) Filed: Aug. 12, 2002

(65) Prior Publication Data

US 2003/0151520 A1 Aug. 14, 2003

Related U.S. Application Data

(60) Provisional application No. 60/356,030, filed on Feb. 11, 2002, and provisional application No. 60/383,836, filed on May 28, 2002.

(51) Int. Cl.[7] ..... B61L 27/00

(52) U.S. Cl. ..... 246/2 F; 246/167 R

(58) Field of Search ..... 246/2 R, 7, 2 F, 246/167 R, 125, 262, 363

(56) References Cited

U.S. PATENT DOCUMENTS

| | | | | |
|---|---|---|---|---|
| 4,360,873 A | | 11/1982 | Wilde et al. | |
| 4,401,035 A | | 8/1983 | Spigarelli et al. | |
| 5,039,038 A | * | 8/1991 | Nichols et al. | 246/3 |
| 5,164,941 A | | 11/1992 | Delaney et al. | |
| 5,500,799 A | | 3/1996 | Balukin et al. | |
| 5,511,749 A | | 4/1996 | Horst et al. | |
| 5,530,328 A | | 6/1996 | Fernandez et al. | |
| 5,564,657 A | | 10/1996 | Dimsa et al. | |
| 5,630,565 A | | 5/1997 | Lumbis | |
| 5,685,507 A | * | 11/1997 | Horst et al. | 246/187 A |
| 5,720,455 A | * | 2/1998 | Kull et al. | 246/187 C |
| 5,787,371 A | | 7/1998 | Balukin et al. | |
| 6,095,618 A | * | 8/2000 | Heneka et al. | 303/3 |
| 6,175,784 B1 | | 1/2001 | Jicha et al. | |
| 6,322,025 B1 | | 11/2001 | Colbert et al. | |
| 6,505,104 B2 | * | 1/2003 | Collins | 701/19 |
| 2001/0020430 A1 | | 9/2001 | Lenz | |
| 2001/0037167 A1 | | 11/2001 | Barberis et al. | |
| 2002/0002583 A1 | | 1/2002 | Fabri et al. | |
| 2002/0006789 A1 | | 1/2002 | Papini et al. | |

FOREIGN PATENT DOCUMENTS

| | | |
|---|---|---|
| DE | 19830053 C1 | 11/1999 |
| EP | 0748082 A1 | 12/1996 |
| EP | 0748085 A1 | 12/1996 |
| EP | 1106469 A1 | 6/2001 |

* cited by examiner

*Primary Examiner*—S. Joseph Morano
*Assistant Examiner*—Robert J. McCarry, Jr.
(74) *Attorney, Agent, or Firm*—Carl Rowold, Esq.; Enrique J. Mora, Esq.; Beusse, Brownlee, Wolter, Mora & Maire, P.A.

(57) ABSTRACT

An improved railroad communication system configurable to comply with newly proposed FRA regulations and further configurable to addresses the concern of communications conflicts is provided. The railroad communication system includes a first radio communication system operating in a first frequency band of about 450 MHz band for communication with a locomotive. The system further includes a second radio communication system operating in a second frequency band selected to be different from the first frequency so as to avoid interference with the first radio communication system for communication with the locomotive. A processor on the locomotive enables the locomotive to selectively respond to the designated control signals so that operation of the locomotive will respond only to the appropriate control signals.

37 Claims, 3 Drawing Sheets

RAILROAD COMMUNICATION SYSTEM

This application claims the benefit of U.S. Provisional Patent Application No. 60/356,030 filed Feb. 11, 2002, and further claims the benefit of U.S. Provisional Patent Application No. 60/383,836 filed May 28, 2002.

FIELD OF THE INVENTION

The present invention relates to a railroad communication system.

BACKGROUND OF THE INVENTION

Railyard remote control systems for locomotives (hereinafter referred to as Remote Control or RC systems or simply RC) are known in the railroad industry. Remotely controlled locomotives are controlled through use of a radio transmitter and receiver system operated by an operator not physically located at the controls within the confines of the locomotive cab. One such system is commercially available from Canac Inc. and is described in Canac's U.S. Pat. Nos. 5,511,749 and 5,685,507. Another RC system is offered by Cattron-Theimeg, Inc.

It is also known to provide distributed power control systems for locomotives (hereinafter Distributed Power or DP systems or simply DP), in which the operation of one or more remote locomotives (or group of locomotives forming a train consist) is remotely controlled from the lead locomotive of the train by way of a radio or hard-wired communication system. One such radio based DP system is commercially available under the trade designation Locotrol® radio, and is described in U.S. Pat. No. 4,582,280, which enables communications among locomotives when connected together to form a consist or at spaced locations along the length of train when the locomotives are spaced apart by one or more railcars for so-called "inter-consist" communications. Hard-wired systems have been available for over 20 years from companies, but provide communications between locomotives only when they are directly connected mechanically together to form a consist and electrically together via so-called Multiple Unit (MU) cables for so-called "intra-consist" communications.

DP control is provided using an FCC-approved frequency allocated for railroad operations in the 450 MHz frequency range at power levels of about 30 Watt. DP radio systems are capable of providing reliable and accurate locomotive control during conditions when the radio channel is free of interference. However, when interference is present, special communication techniques, such as unique locomotive identifiers and time randomization, have been developed to mitigate communication conflicts, such as in situations where a large number of locomotives are operated within a relatively small geographical area, such as in a train yard, industrial site, etc.

Known RC radios have adopted the same FCC-approved frequency, which adds to communication conflicts in high-volume train yards. In addition, because RC locomotives are generally operable in a rail yard while DP locomotives are relatively transient, RC radios add to the EM noise around the train yard for neighboring residents and further restrict the available bandwidth for other communications on the FCC-approved frequency.

It is also known to communicate between individual cars in a train via radio to control braking and other functions for what is commonly referred to in the industry as Electronically Controlled Braking, (ECPB). See for example, U.S. Pat. No. 6,400,281 in connection with an innovative technique of train communication for providing ECPB.

In another regard, recently in the U.S., the Federal Railroad Administration (FRA) has proposed regulations that prescribe that the status of certain locomotive systems, such as the dynamic braking system, in trail locomotives be communicated to the operator in the lead locomotive. Typically, the Multiple Unit (MU) cable is provided between adjacent locomotives for conveying intra-consist data. Unfortunately, the existing analog communication protocol of the MU cable lacks the communication capacity to meet these regulations. In addition, when the locomotives are arranged in a set of distributed consists at spaced locations along the train there is no effective way to communicate the MU cable intra-consist data of each consist to the lead locomotive via DP radio in that these are separate systems that typically do not communicate with each other.

The types of radio systems described above, e.g., RC, DP, MU, and ECPB, each may have widely varying communications needs to provide a respective train functionality yet each of such system may be competing for the same limited radio bandwidth. Thus, it would be desirable to provide communication system and techniques that appropriately address any desired train functionality notwithstanding of a limited frequency spectrum.

BRIEF DESCRIPTION OF THE INVENTION

Thus, an improved railroad communication system is needed that accommodates the ever-growing demand for radio based mobile assets within a rail yard and elsewhere. A significant advantage regarding utilization of the limited frequency spectrum available to owners and operators of railroad assets is gained by providing compatibility at least between RC and DP radio communications without increasing radio interference among locomotive and other FCC approved railroad operations communications, and providing both inter-consist and intra-consist communication for complying with the regulations.

Generally, the present invention fulfills the foregoing needs by providing in one aspect thereof, a railroad communication system including a first radio communication system operating in a first frequency band of about 450 MHz band for communication with a locomotive. The system further includes a second radio communication system operating in a second frequency band selected to avoid interference with the first radio communication system for communication with the locomotive. In other aspects thereof, the system may be configured to make use of either or both of the first and second radio communications system as appropriate to obtain efficient use of the limited bandwidth allocated to each frequency range while supporting the unique communications needs of the train function being performed at any given time.

The foregoing structural and operational interrelationships result in an improved communications system that with a high degree of versatility addresses multiple needs in the railroad industry, such as making efficient use of capability of existing hardware (avoids the need to adopt a new standard for MU cable), reduced radio power levels and EM noise emissions and relieving switch yard communications clutter. The above needs are advantageously addressed without having to go through burdensome FCC site license requirements, if, for example, an ISM band is used in the second radio communication system. In addition, aspects of the present invention allow providing a reliable system for communicating data under the proposed FRA regulations between locomotives.

DETAILED DESCRIPTION OF THE INVENTION

I. General System Description

Figure 1:
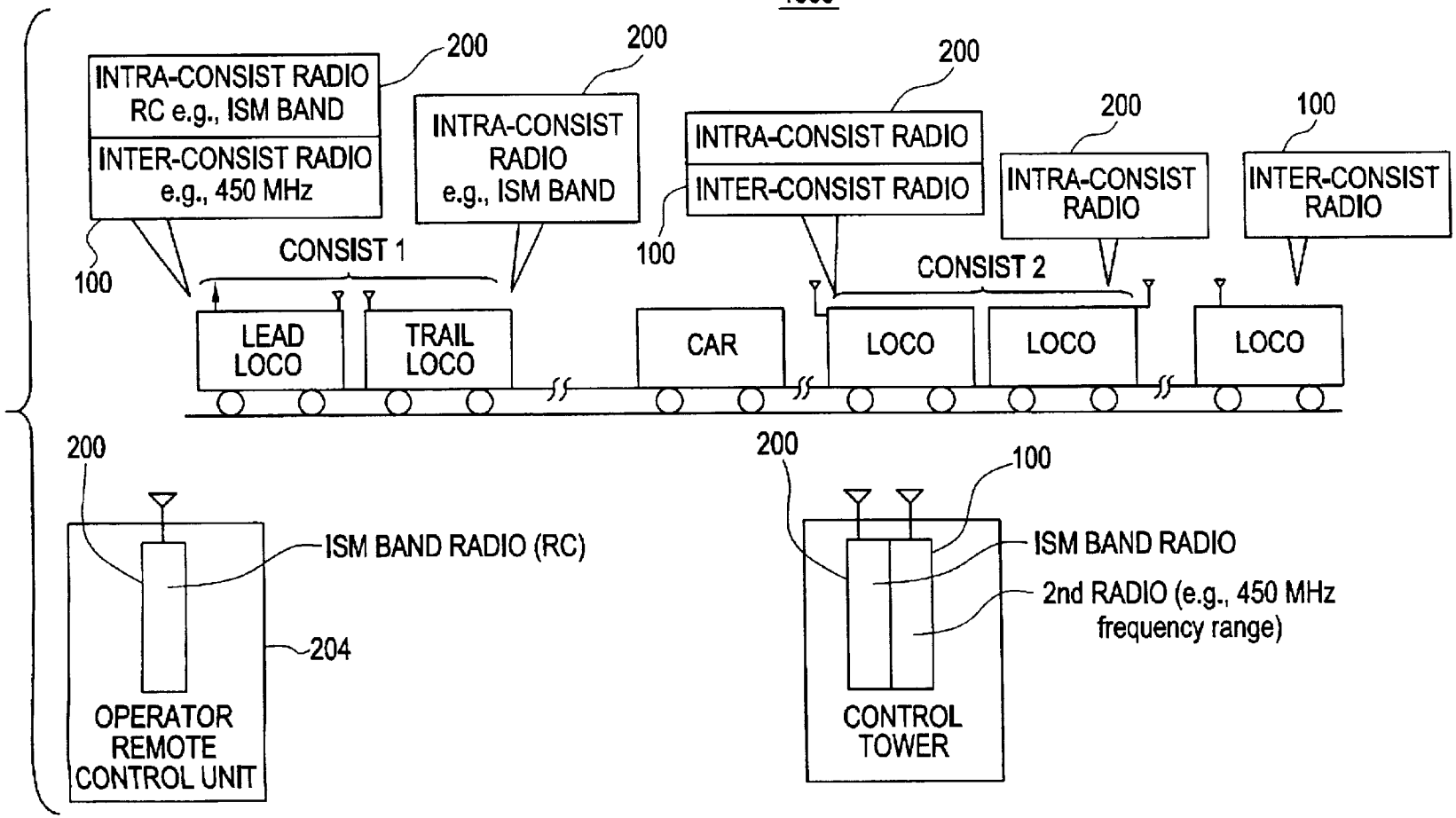
FIG. 1 is a schematic of an exemplary train including a wireless communication system configurable to provide multi-communication functionality, such as RC control or control tower, and to transmit data across remote consists (inter-consist communication) of locomotives, or within each locomotive in a respective consist, (intra-consist communication), or each of the above.

The present inventors have innovatively recognized that the probability of communication conflict between RC and DP systems may be substantially reduced, without introducing burdensome regulatory approvals, by configuring a railroad communication system 1000 that utilizes both a first radio subsystem 100, such as the existing Locotrol system, and a second radio subsystem 200. For example, a transmitter in the second radio subsystem 200 (FIG. 1) in a portable operator control unit (OCU) 204 and a receiver in the second radio subsystem 200 on-board the lead locomotive may be configured to operate at a frequency band selected to avoid interference with the first radio subsystem. It will be appreciated that the first radio subsystem may be configured to operate with a first communication protocol, and the second radio subsystem may be configured to operate with a second communications protocol configured to further avoid interference with the first communication subsystem for communicating relative to the locomotive. See U.S. patent application Publication No. 2003/0214417 A1, published Nov. 20, 2003, titled "Intelligent Communications, Command and Control for a Land-based Vehicle" regarding use of various communication schemes to provide acceptable communications quality under diverse operational, or environmental conditions, or both. The foregoing U.S. patent application, which is commonly assigned to the same assignee of the present invention, is herein incorporated by reference in its entirety. In one exemplary embodiment, the second radio subsystem comprises an ISM band (Industrial Scientific Medical band) radio subsystem using, for example, spread-spectrum communication techniques and a power level of about no more than one Watt. It is believed that this novel approach allows for 20 or more locomotives to be operated, essentially free of communication interference, within radio line of sight in a given railroad yard. This represents a significant improvement over the fewer number of locomotives that may be simultaneously operated under traditional techniques. The improved railroad communication system 1000 may have a reduced impact on areas neighboring a switch yard due to the use of a second radio subsystem 200 having a lower power output level than the first radio subsystem 100. For example, the DP system may broadcast at power levels of approximately 30 watts. On the other hand, the RC system may be configured to broadcast at power levels of approximately one watt or less. The foregoing power levels for the RC system advantageously do not require FCC approval in the ISM band. Furthermore, the lower power output of the second radio subsystem would enable such radio to be configured as a relatively lightweight and portable radio that may be carried by an operator and reliably operated for an extended period of time without having to replace or recharge the power source (e.g., battery) associated with the portable radio.

In another aspect thereof, the improved railroad communication system 1000 may be used to satisfy the new FRA regulations without the need for a redesign of the existing MU line by configuring the second radio subsystem 200 for intra-consist communication or for inter-consist communication within a train to convey the data required by the new FRA regulations.

As will be now appreciated by those skilled in the art, uncomplicated and inexpensive repeaters may be added in rail yards with line of sight obstructions to provide effective radio coverage for the communication system 1000 within about two miles or more. ISM band is a term describing several frequency bands in the radio spectrum. By way of example, ISM bands include 902–928 Mhz, 2.4–2.483 Ghz and 5.725–5875 Ghz. ISM frequencies are advantageously used for the second radio subsystem 200 because the use of such frequencies does not require an FCC license. Accordingly, the improved communication system 1000 may be implemented with a minimized cost impact by utilizing existing communication capacity on the railroad as embodied in communication system 100 and by augmenting that capacity with a relatively low cost, non-regulated second radio subsystem 200.

As suggested above, one exemplary embodiment of the present invention allows providing RC control in a train yard and/or intra-consist data communication with a low power, unregulated radio subsystem 200 operating on a non-conflicting frequency band that may be used in conjunction with or ancillary to a radio subsystem 100 that provides inter-consist data communication, such as the above-noted Locotrol communications system.

FIG. 1 illustrates a railroad communication system for communicating data to a locomotive in a train, which may include respective consists of locomotives. It will be understood that, in its broader aspects, the present invention is not limited to train configurations using multiple locomotives since, for example, RC control, (e.g., in a train yard) can be provided to a train equipped with a single locomotive. Further, the benefits of the present invention are readily applicable to single locomotive configurations since in a high volume train yard, the likely sources of communication interference would be neighboring trains, which are likely to include DP or inter-consist control. Thus, the fact that FIG. 1 illustrates a train with multiple locomotive consists should not be construed as a limitation of the present invention.

In another advantageous feature of the present invention, it will now be appreciated that the second radio that may provide RC control during train yard operations (e.g., operating in an ISM band) may be configurable to provide multi-communication capability since that same radio may be utilized for providing intra-consist data. For example, this would advantageously allow a railroad to fulfill the newly proposed FRA requirements that the MU cable is presently unable to meet. More specifically, the second radio communication system may be configured to communicate data indicative of the status of a system (e.g., propulsion, braking, lighting, orientation, horn, etc.) of a second locomotive in a multi-locomotive consist. In addition, this enhanced ability to provide wireless communication between locomotives previously interconnected via the MU cable provides both communication link redundancies as well as communication link enhancements not possible prior to the present invention. For example, assuming there is a malfunction in the MU cable, that malfunction would not disrupt locomotive control since the wireless link would be able to back up any such malfunctions. Moreover, it is contemplated that data transfer rates provided by the wireless link may, in many instances, exceed the data transfer rates presently provided by the MU cable. For example, there may be control modes that would now be more effectively provided because of the improved data transfer rates through the wireless communication link enabled by the second radio system. Once again, because of the adept choice of frequency for the second radio system, the intra-consist data communication would be, the same as the RC data communication, free from communications interference from within the same train or external sources that may transmit in the frequency band of the first radio. As used herein intra-consist data refers to data indicative of status and command information for independently and coordinatedly controlling respective systems, e.g., propulsion system, dynamic braking system, etc., onboard each locomotive of a respective consist.

Thus, it will be appreciated that the inventors of the present invention have innovately recognized an improved communications system that with a high degree of versatility and clever use of available resources addresses multiple needs in the railroad industry, such as making efficient use of capability of existing hardware (avoids the need to adopt a new standard for MU cable); relieving switch yard communications clutter. The above needs are advantageously addressed without having to go through burdensome FCC site license requirements, if, for example, an ISM band is used in the second radio communication system.

Figure 2:
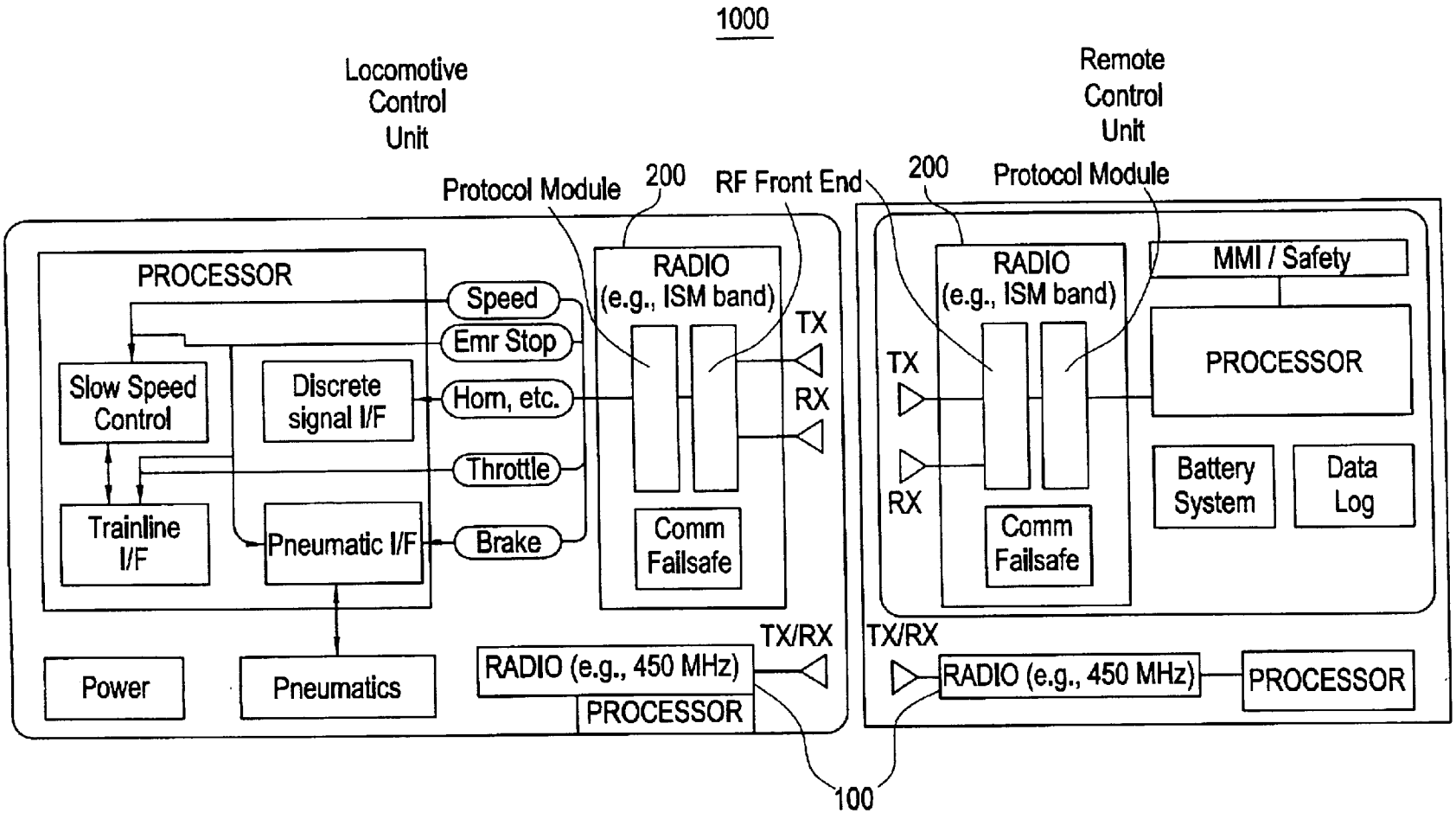
FIG. 2 is a block diagram representation of an exemplary receiver and transmitter embodying aspects of a locomotive control unit and a remote control unit configured to communicate at two distinct frequency bands.

FIG. 2 illustrates in a block diagram representation additional details of one exemplary embodiment for the first and second radio communication systems embodying aspects of the present invention. For example, each radio may include its respective processor with memory for storing the appropriate software for performing, for example, DP control in the first radio, and RC control and/or intra-consist communication in the second radio. Although FIG. 2 illustrates the first and second radio systems as combined and integrated in a common unit, it will be appreciated that such radios may be provided as separate units. For example, one type of remote control unit may be a portable unit carried by an operator. Another type of remote control unit may be part of a control tower in a train yard. It will be further appreciated that the radios need not be two distinct pieces of hardware since the same hardware may be programmed to operate at distinct frequency bands using techniques that would be well-understood by those skilled in the art.

Figure 3:
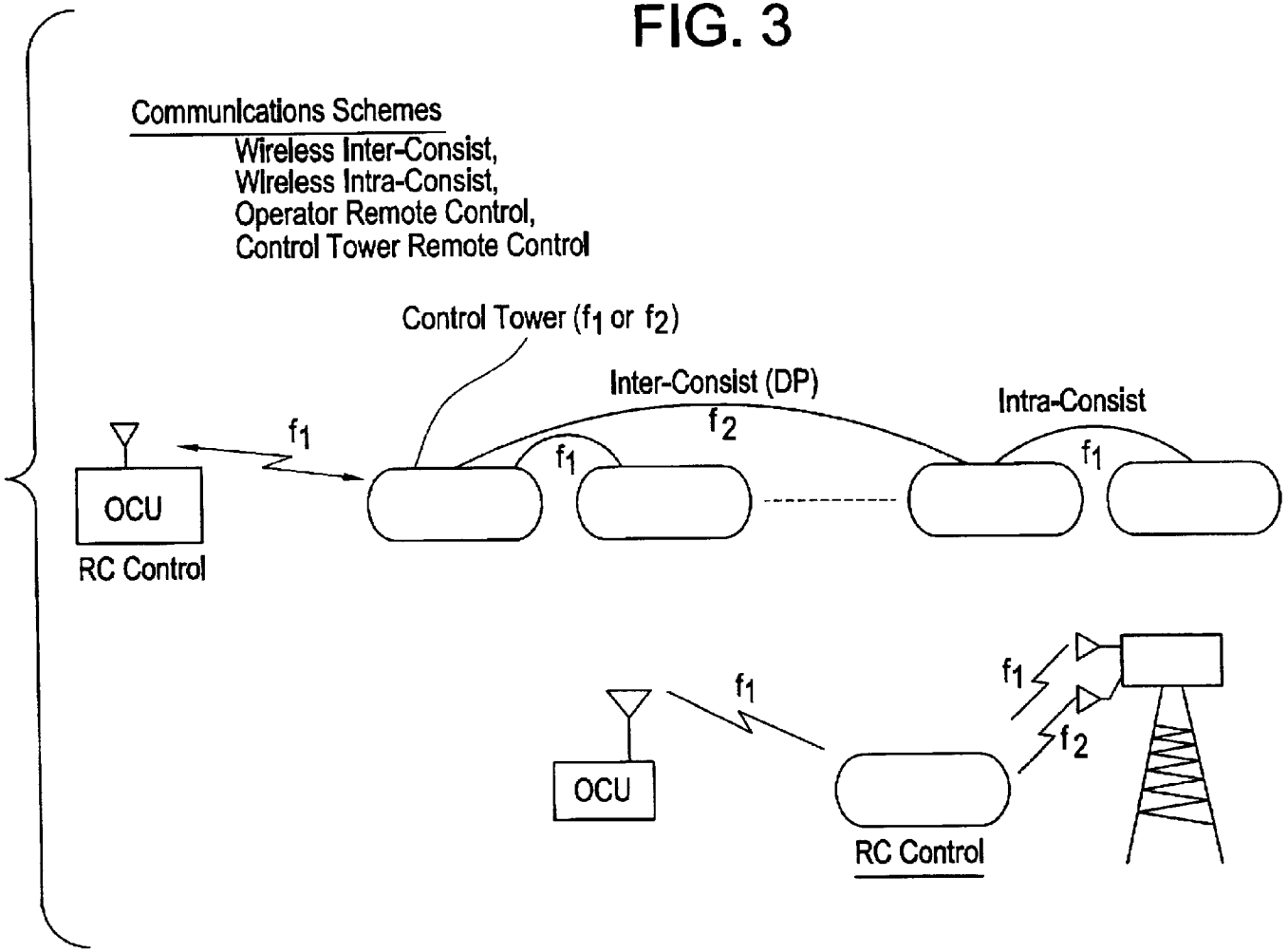
FIG. 3 illustrates an exemplary communication scheme that may benefit from the teachings of the present invention.

FIG. 3 illustrates various exemplary communication schemes that may benefit from the present invention. By way of example, in one aspect of the present invention, RC control may be provided at an ISM band (e.g., frequency f1) from an Operator Control Unit (OCU) configured to provide such RC control. In the event communication of enhanced intra-consist data is desired (e.g., to fulfill FRA requirements), then such ISM band may be used for wirelessly communicating such intra-consist data. In the event distributed propulsion is desired, such as may be provided by a DP radio system, then that system, which operates at a different frequency than frequency f1 (e.g., frequency f2), would not create communication interference to neighboring trains, notwithstanding of the relatively higher RF output power of the DP radio system relative to the OCU.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A railroad communication system for controlling operation of a locomotive by at least two different locomotive control units, with the communication system comprising:

a first locomotive control unit, mounted on and operably connected to the locomotive, the first locomotive control unit comprising a first radio transmitter and receiver subsystem capable of communicating with a first remote control unit at a first frequency band of about 450 MHz band for controlling operation of the locomotive;

a second locomotive control unit, mounted on and operably connected to the locomotive, the second locomotive control unit comprising a second radio transmitter and receiver subsystem capable of communicating with a second remote control unit at a second frequency band different from the first frequency band and selected to avoid interference with the first radio transmitter and receiver subsystem for communication with the locomotive;

a first processor, operably connected to the first radio transmitter and receiver subsystem for responding to the first remote control unit for controlling the operation of the locomotive in response to control signals from the first remote control unit;

a second processor, operably connected to the second radio transmitter and receiver subsystem for responding to the second remote control unit for controlling the operation of the locomotive in response to control signals from the second remote control unit; and whereby operation of the locomotive can be selectively controlled by one of the remote control units without causing interference with communications with the other locomotive control unit or other locomotives, with the locomotive responding to only the selected remote control unit.

2. The railroad communication system of claim 1, wherein the first radio transmitter and receiver subsystem, the first processor, the second radio transmitter and receiver subsystem, and the second processor are integrated and combined in a single locomotive control unit.

3. The railroad communication system of claim 1, wherein the first processor and the second processor are integrated into a single processor.

4. The railroad communication system of claim 1, wherein the first radio transmitter and receiver subsystem and the second radio transmitter and receiver subsystem are integrated and combined in a single radio transmitter and receiver subsystem capable of transmitting and receiving on at least two different frequencies.

5. The railroad communication system of claim 1, wherein the first radio transmitter and receiver subsystem is part of a wireless communication link for communicating between locomotives in different consists in a multi-consist train, constituting inter-consist communications.

6. The railroad communication system of claim 1, wherein the second radio transmitter and receiver subsystem is part of a wireless communication link for communicating between the locomotive and a location remote to the locomotive.

7. The railroad communication system of claim 1, wherein the second radio transmitter and receiver subsystem comprises a radio frequency (RF) power output less than a radio frequency (RF) power output of the first radio transmitter and receiver subsystem.

8. The railroad communication system of claim 1, wherein the second radio transmitter and receiver subsystem comprises a radio frequency (RF) power output less than maximum allowable power to be free from regulatory approval.

9. The railroad communication system of claim 1, wherein the second radio transmitter and receiver subsystem comprises a radio frequency (RF) band that is usable without regulatory approval.

10. The railroad communication system of claim 7, wherein the first radio transmitter and receiver subsystem comprises an RF power output of approximately 30 watts and the second radio transmitter and receiver subsystem comprises an RF power output of approximately 1 watt.

11. The railroad communication system of claim 1, wherein the second frequency band comprises an ISM band.

12. The railroad communication system of claim 1, wherein the second remote control unit comprises a portable control unit adapted to be carried by an operator for remote control operation of the locomotive.

13. The railroad communication system of claim 12, wherein the second remote control unit further comprises a first radio transmitter and receiver subsystem and a second radio transmitter and receiver subsystem for selectively communicating with the first and the second locomotive control units.

14. The railroad communication system of claim 1, wherein the second remote control unit is mounted in a train control tower.

15. The railroad communication system of claim 1, wherein the second remote control unit is mounted on another locomotive in a multi-locomotive consist for intra-consist communication.

16. The railroad communication system of claim 1, wherein information passed between the second remote control unit and the second radio transmitter and receiver subsystem comprises locomotive status data.

17. The railroad communication system of claim 16, wherein the locomotive status data comprises data required by the Federal Railroad Administration.

18. The railroad communication system of claim 1, wherein the first remote locomotive control unit is mounted on another locomotive in a different consist in a multi-consist train for inter-consist communications.

19. A railroad communication system comprising:

a first radio communication system for communicating control signals to control the operation of a locomotive in a train operating at a first power level and in a first frequency band of about 450 MHz band for communication with a locomotive; and a second radio communication system for communicating control signals to control the operation of a locomotive in a train operating at a second power level lower than the first and in a second frequency band different from first band selected to avoid interference with the first radio communication system for communication with the locomotive, and wherein the second frequency band and power level thereof are each chosen to be free from regulatory approval.

20. A method for controlling operation of a locomotive by at least two different locomotive control units comprising:

providing a first locomotive control unit mounted on and operably connected to the locomotive;

configuring the first locomotive control unit to communicate by way of a first radio transmitter and receiver subsystem with a first remote control unit at a first frequency band of about 450 MHz band for controlling operation of the locomotive;

providing a second locomotive control unit mounted on and operably connected to the locomotive;

configuring the second locomotive control unit to communicate by way of a second radio transmitter and receiver subsystem with the second remote control unit at a second frequency band different from the first frequency band and selected to avoid interference with the first radio transmitter and receiver subsystem for communication with the locomotive;

operating the first locomotive control unit in response to the first remote control unit for controlling the operation of the locomotive in response to control signals from the first remote control unit;

operating the second locomotive control unit in response to the second remote control unit for controlling the operation of the locomotive in response to control signals from the second remote control unit; and selectively controlling operation of the locomotive without causing interference with communications with other locomotive control units or other locomotives, with the locomotive responding to only the selected remote control unit.

21. The method of claim 20, further comprising combining in a single locomotive control unit the first radio transmitter and receiver subsystem, the first processor, the second radio transmitter and receiver subsystem, and the second processor.

22. The method of claim 20, further comprising combining in a single processor the first processor and the second processor.

23. The method of claim 20, further comprising combining in a single radio transmitter and receiver subsystem capable of transmitting and receiving on at least two different selectable frequencies the first radio transmitter and receiver subsystem and the second radio transmitter and receiver subsystem.

24. The method of claim 20, wherein the first radio transmitter and receiver subsystem is part of a wireless communication link for communicating between locomotives in different consists in a multi-consist train, constituting inter-consist communications.

25. The method of claim 20, wherein the second radio transmitter and receiver subsystem is part of a wireless communication link for communicating between the locomotive and a location remote to the locomotive.

26. The method of claim 20, wherein the second radio transmitter and receiver subsystem is operable at a radio frequency (RF) power output less than a radio frequency (RF) power output of the first radio transmitter and receiver subsystem.

27. The method of claim 20, wherein the second radio transmitter and receiver subsystem is operable a radio frequency (RF) power output less than maximum allowable power to be free from regulatory approval.

28. The method of claim 20, wherein the second radio transmitter and receiver subsystem is operable at a radio frequency (RF) band that is usable without regulatory approval.

29. The method of claim 26, wherein the first radio transmitter and receiver subsystem is operable at an RF power output of approximately 30 watts and the second radio transmitter and receiver subsystem is operable at an RF power output of approximately 1 watt.

30. The method of claim 20, wherein the second frequency band comprises an ISM band.

31. The method of claim 20, wherein the second remote control unit comprises a portable control unit adapted to be carried for remote control operation of the locomotive.

32. The method of claim 31, wherein the second remote control unit further comprises a first radio transmitter and receiver subsystem and a second radio transmitter and receiver subsystem for selectively communicating with the first and the second locomotive control units.

33. The method of claim 20, wherein the second remote control unit comprises a remote control unit mounted in a train yard control tower.

34. The method of claim 20, wherein the second remote control unit comprises a locomotive control unit mounted on another locomotive in a multi-locomotive consist for intra-consist communication.

35. The method of claim 20, further comprising communicating information indicative of locomotive status data between the second remote control unit and the second radio transmitter and receiver subsystem.

36. The method of claim 35, wherein the locomotive status data comprises data required by the Federal Railroad Administration.

37. The method of claim 20, wherein the first remote control unit comprises a locomotive control unit mounted on another locomotive in the train.

* * * * *